US005455135A

United States Patent [19]

Maruyama et al.

[11] Patent Number: 5,455,135

[45] Date of Patent: Oct. 3, 1995

[54] ELECTROPHOTOGRAPHIC PHOTOSENSITIVE MEMBER WITH OVERLAYER AND ELECTROPHOTOGRAPHIC APPARTUS EMPLOYING SAME

[75] Inventors: Akio Maruyama, Tokyo; Kazushige Nakamura, Yokohama; Shoji Amamiya, Kawasaki; Shin Nagahara, Inagi; Haruyuki Tsuji, Yokohama; Masaaki Yamagami, Tsuruga; Michiyo Sekiya, Tokyo, all of Japan

[73] Assignee: Canon Kabushiki Kaisha, Tokyo, Japan

[21] Appl. No.: 167,049

[22] Filed: Dec. 16, 1993

[30] Foreign Application Priority Data

Dec. 18, 1992 [JP] Japan ..... 4-354963

[51] Int. Cl.[6] ..... G03G 5/147; G03G 15/22

[52] U.S. Cl. ..... 430/58; 430/66; 430/67; 355/211; 358/300; 358/302

[58] Field of Search ..... 430/58, 66, 67; 355/211; 358/300, 302

[56] References Cited

FOREIGN PATENT DOCUMENTS

| | | | |
|---|---|---|---|
| 415446 | 3/1991 | European Pat. Off. . | |
| 0443626 | 8/1991 | European Pat. Off. | 430/67 |
| 460558 | 12/1991 | European Pat. Off. . | |
| 464749 | 1/1992 | European Pat. Off. . | |
| 501769 | 9/1992 | European Pat. Off. . | |
| 504794 | 9/1992 | European Pat. Off. . | |
| 69641 | 6/1981 | Japan | 430/67 |
| 57-30843 | 2/1982 | Japan . | |
| 159168 | 9/1989 | Japan | 430/67 |
| 139656 | 6/1991 | Japan | 430/67 |

*Primary Examiner*—Roland Martin

*Attorney, Agent, or Firm*—Fitzpatrick, Cella, Harper & Scinto

[57] ABSTRACT

An electrophotographic photosensitive member includes an electroconductive substrate, a photosensitive layer disposed on the electroconductive substrate, and a protective layer disposed on the photosensitive layer, the protective layer containing a resin formed by polymerization of compounds each having two or more ion polymerizable functional groups, and electroconductive particles.

18 Claims, 1 Drawing Sheet

ELECTROPHOTOGRAPHIC PHOTOSENSITIVE MEMBER WITH OVERLAYER AND ELECTROPHOTOGRAPHIC APPARTUS EMPLOYING SAME

BACKGROUND OF THE INVENTION

1. Filed of the Invention

The present invention relates to an electrophotographic photosensitive member, more particularly to an electrophotographic photosensitive member having a protective layer which contains a specific resin and electroconductive particles. The present invention relates to an electrophotographic apparatus and a device unit which employ the photosensitive member.

2. Description of the Prior Art

An electrophotographic photosensitive member must have desired sensitivity, electrical characteristics and optical characteristics corresponding to the applied electrophotographic process. In particular, a photosensitive member of a type that is used repeatedly must have durability against electrical or mechanical external forces repeatedly applied during corona charging, toner development, transference to paper and cleaning.

Specifically, the surface of the photosensitive member must resist wear or damage generated due to friction and deterioration by ozone, which is readily generated at the time of corona discharge when allowed to take place in a high humidity atmosphere. Further, electrophotographic photosensitive members must overcome a problem of adhesion of toner to the surface of the photosensitive member occurring due to repetition of the development operation and during the cleaning operation. Therefore, it has been desired to provide a surface of a photosensitive member which is cleaned rather easily.

In order to meet the various needs for the surface of the photosensitive member, attempts have been made to provide a surface protective layer mainly composed of resin formed on the photosensitive layer. For example, Japanese Patent Application Laid-Open No. 57-30843 has proposed a protective layer capable of having a controlled resistivity by using a mixture of a resin and metal oxide particles as electroconductive particles.

However, the foregoing methods have suffered from unsatisfactory dispersion of metal oxide particles in a binder resin. That problem leads to a defect that the conductivity and the transparency of the protective layer have been adversely affected. Therefore, problems sometimes take place in that the formed image has a defect due to the uneven protective layer, the residual potential undesirably rises after the photosensitive member has been used repeated, and the sensitivity deteriorates excessively. In order to cause the protective layer to have excellent transparency and uniform conductivity, it is very important to disperse very fine particles (having an average primary particle size of 0.1 μm or less). Very fine particles of the foregoing type suffer from unsatisfactory stability as compared with ordinary fine particles (having an average primary particle size of 0.5 μm or more), so that secondary aggregation tends to proceed with time, and the size of the dispersed particle tends to be enlarged undesirably. As a result, there arise a problem of deterioration of the transparency and the uniformity of the conductivity.

To meet growing demands for further improving image quality and durability, an electrophotographic photosensitive member having better electrophotographic characteristics as mentioned above must be developed.

SUMMARY OF THE INVENTION

An object of the present invention is to provide an electrophotographic photosensitive member including a protective layer exhibiting excellent transparency and satisfactory conduction uniformity.

Another object of the present invention is to provide an electrophotographic photosensitive member which is capable of forming excellent images even if it is used repeatedly.

Another object of the present invention is to provide an electrophotographic apparatus and a device unit having the foregoing electrophotographic photosensitive member.

According to one aspect of the present invention, there is provided an electrophotographic photosensitive member comprising: an electroconductive substrate; a photosensitive layer disposed on the electroconductive substrate; and a protective layer disposed on the photosensitive layer, the protective layer containing (i) a resin formed by polymerization of compounds each having two or more ionic polymerizable functional groups, and (ii) and electroconductive particles.

According to another aspect of the present invention, there are provided an electrophotographic apparatus and a device unit having the electrophotographic photosensitive member.

Other and further objects, features and advantages of the invention will be appear more fully from the following description.

DESCRIPTION OF THE PREFERRED EMBODIMENTS

Figure 1:
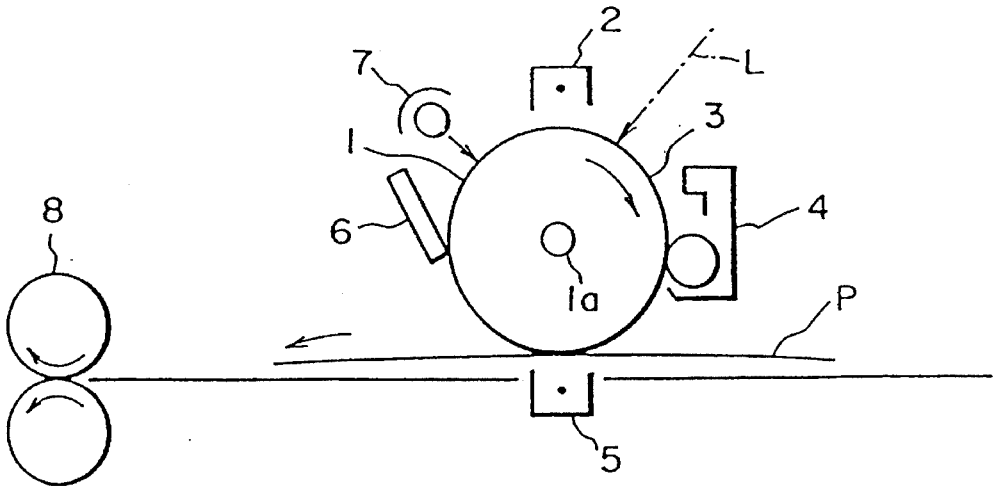
FIG. 1 schematically illustrates the structure of an electrophotographic apparatus employing an electrophotographic photosensitive member according to the present invention.

A protective layer of an electrophotographic photosensitive member according to the present invention contains a resin and electroconductive particles, and the resin is obtainable from polymerization of compounds each having two or more ionic polymerizable functional groups. Preferred examples of the ionic polymerizable functional groups are epoxy materials, vinyl ethers, vinyl materials each having an electron donative group, ring ethers, thiirane ring materials and ring polyorganosiloxanes. Concrete examples of those functional groups are shown below together with the polymerized unit. However, the present invention is not limited to the description below.

Epoxy Materials

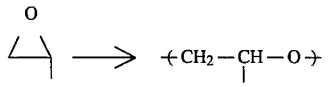

-continued

Vinyl Ethers

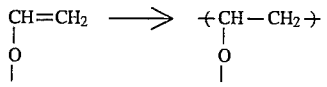

Vinyl Materials Having Electron Donative Group

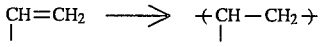

Ring Ethers

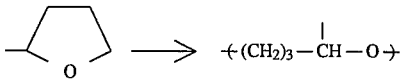

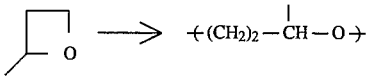

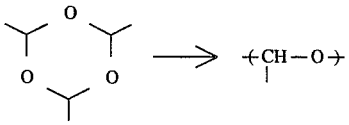

-continued

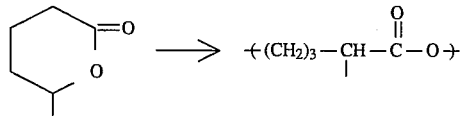

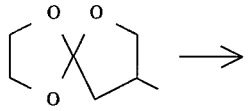

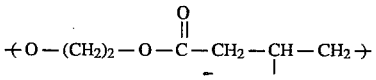

Thiirane Ring Material

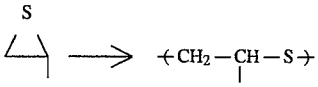

Ring Polyorganosiloxanes

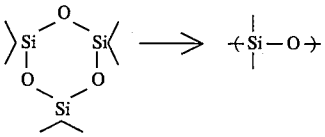

Preferred compounds having two or more groups of the foregoing type will now be described. However, the present invention is not limited to the descriptions below.

Example Compound 1

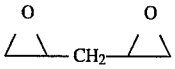

Number of Functional Groups: 2

Example Compound 2

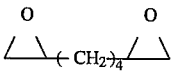

Number of Functional Groups: 2

Example Compound 3

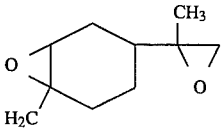

Number of Functional Groups: 2

Example Compound 4

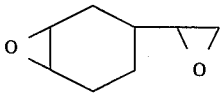

Number of Functional Groups: 2

Example Compound 5

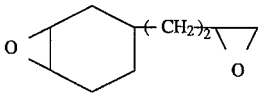

Number of Functional Groups: 2

Example Compound 6

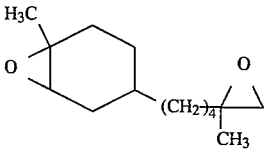

Number of Functional Groups: 2

Example Compound 7

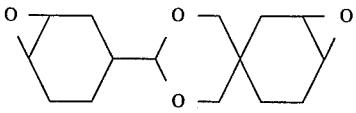

Number of Functional Groups: 2

Example Compound 8

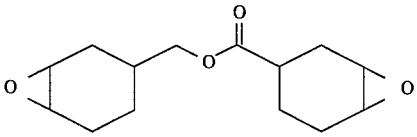

Number of Functional Groups: 2

-continued

Example Compound 9

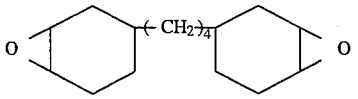

Number of Functional Groups: 2

Example Compound 10

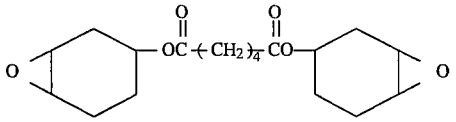

Number of Functional Groups: 2

Example Compound 11

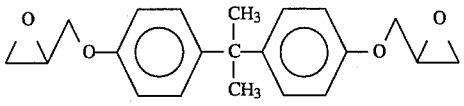

Number of Functional Groups: 2

Example Compound 12

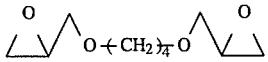

Number of Functional Groups: 2

Example Compound 13

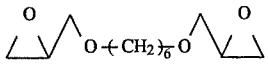

Number of Functional Groups: 2

Example Compound 14

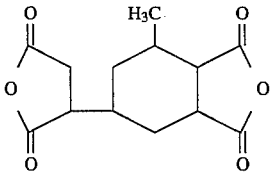

Number of Functional Groups: 2

Example Compound 15

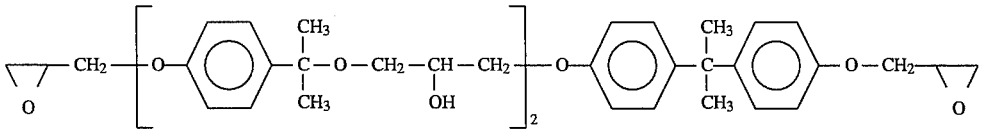

Number of Functional Groups: 2

Example Compound 16

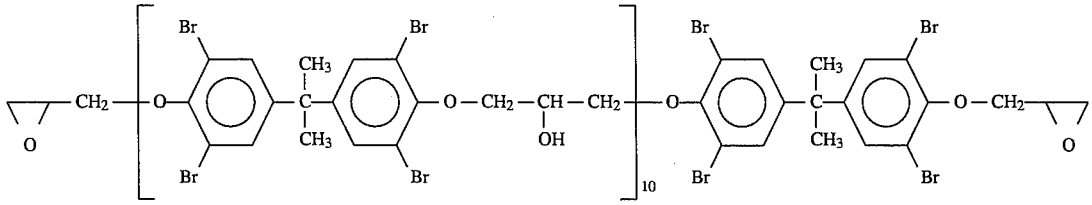

Number of Funtional Groups: 2

Example Compound 17

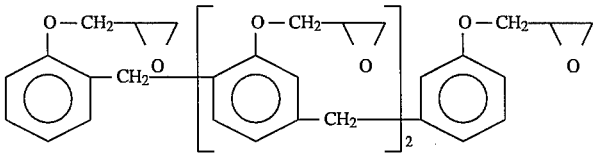

Number of Functional Groups: 4

Example Compound 18

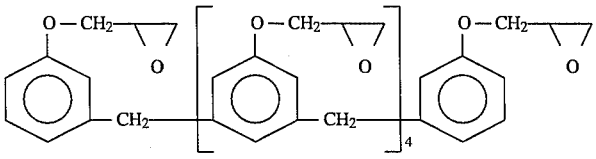

Number of Functional Groups: 6

The compound having the ionic polymerizable functional groups is polymerized when it is irradiated with light in the presence of a photopolymerization initiator.

The photopolymerization initiator may be any material so far as it frees a Lewis acid which causes the polymerization of the ionic polymerizable compound to start. It is preferable to use aromatic diazonium salt, aromatic halonium salt or photosensitive aromatic onium salt of group IVa or group Va element.

The aromatic diazonium salt is represented by the following formula:

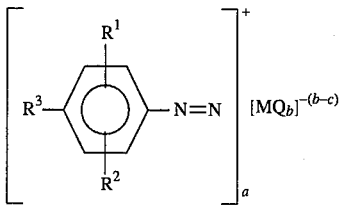

wherein $R^1$ and $R^2$ are each a hydrogen atom, an alkyl group or an alkoxy group, $R^3$ is a hydrogen atom, an aromatic group and an aromatic group connected by an amido group or a sulfur atom, M is metal or semimetal, Q is a halogen atom, a is an integer 1 to 6 which satisfies the relation a=(b−c), b is an integer which satisfies a relation c<b≦8, and c is an integer 2 to 7 which is the same as the valence of M.

Preferred examples are as follows.

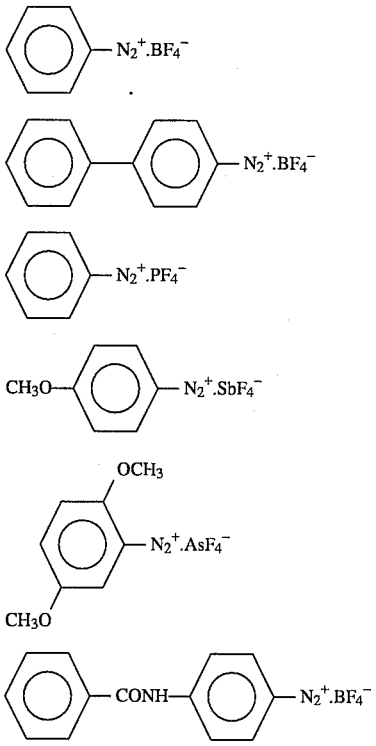

-continued

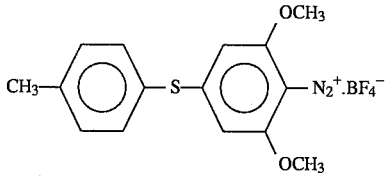

The aromatic halonium salt is represented by the following formula:

$$[(R^4)_d(R^5)_eX]_f^+[MQ]_g^{-(g-h)}$$

wherein $R^4$ is a monovalent aromatic organic group, $R^5$ is a bivalent aromatic organic group, X is a halogen atom, M is metal or semimetal, Q is a halogen atom, d is an integer 0 to 2, e is an integer 0 or 1, (d+e) is the same as the valence of X, g is an integer larger than h and as well not more than 8, and f is an integer which satisfies a relationship f=g×(g−h).

Preferred examples are as follows.

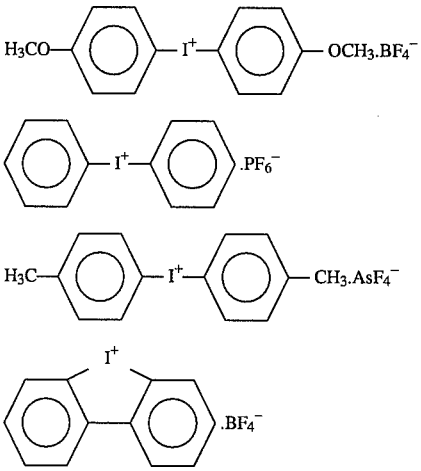

The photosensitive aromatic onium salt of group IVa element or group Va element is expressed by the following formula:

$$[(R^6)_i(R^7)_j(R^8)_kY]_p^+[MQ_m]^{-(m-n)}$$

wherein $R^6$ is a monovalent aromatic organic group, $R^7$ is a monovalent aliphatic organic group, $R^8$ is a multi-valent organic group selected from the group consisting of an aliphatic organic group or an aromatic organic group and having a heterocyclic structure, Y is a group IVa element selected from the group consisting of S, Se and Te or a group Va element selected from the group consisting of N, P, As, b and Bi, M is metal or semimetal, Q is a halogen atom, i is an integer 0 to 4, j and k are each an integer 0 to 2, (i+j+k) is the same as the valence of Y and is 3 when Y is the group IVa element and 4 when Y is the group Va element, m is an integer larger than n and not more than 8, and p is an integer which satisfies a relationship p=m− n.

Preferred examples of the onium salt of the group IVa element are as follows.

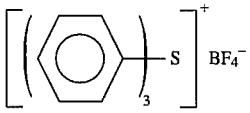

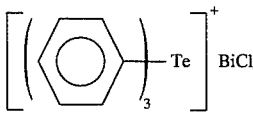

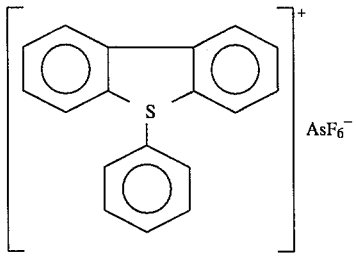

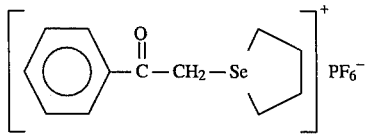

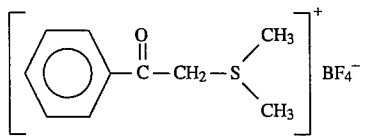

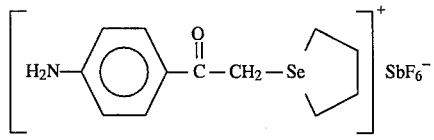

Preferred examples of the onium salt of the group Va element are as follows.

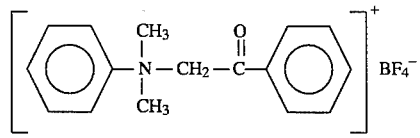

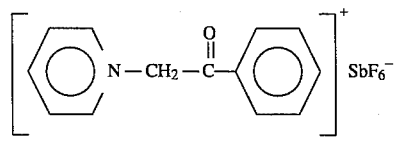

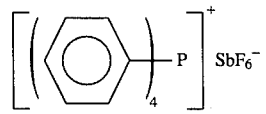

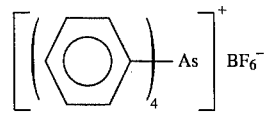

-continued

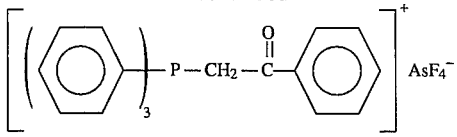

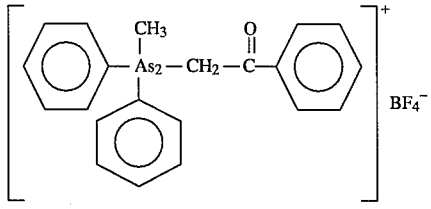

The quantity of the employed photopolymerization initiator may preferably be 0.1 to 50 wt %, more preferably 0.5 to 30 wt % of the ion polymerizable compound.

Light may be any electron beam having sufficiently large energy to cause the polymerization reaction to be commenced as typified by ultraviolet rays, x-rays or electron rays. It is preferable to employ ultraviolet radiation because the ultraviolet rays can easily be handled. The wave length of said ultraviolet rays usually ranges from 200 to 500 nm, preferably 250 to 400 nm, and a light source may preferably be a high pressure or low pressure mercury lamp or an alkali halide lamp. If necessary, the photosensitive member may be heated during the application of ultraviolet rays and/or after the same have been applied.

Since the polymerization reactions according to the present invention and to be performed to obtain the resin is an ionic polymerization reaction that does not generate radicals, radicals do not adversely affect charge transfer substances even if the layer which is in contact with the protective layer contains the charge transfer substances. Since the ionic polymerization is not adversely affected by oxygen, the degree of polymerization adjacent to the surface of the photosensitive member can be raised as compared with the radical polymerization. Therefore, further improved mechanical strength and surface lubrication can be obtained. Since the ionic polymerizable compound according to the present invention has two or more functional groups, it forms a crosslinked structure when polymerized. Therefore, excellent mechanical strength can be obtained. Since stronger crosslinked structure can be obtained, it is preferable for the present invention that the ion polymerizable compound has three or more functional groups.

The present invention may be arranged in such a manner that two or more types of ionic polymerizable compounds are used. In the present invention, a compound, such as phenylglycidyl ether or t-butyl glycidyl ether, of a type having only one ionic polymerizable functional group may be used. Further, the present invention may, of course, use a mixture of two or more types of resins obtainable by using the ionic polymerizable compound according to the present invention. Another resin may be mixed. The resin to be mixed is exemplified by polyester, polycarbonate, polystyrene, polyvinyl chloride, cellulose, fluorine-contained resin, polyethylene, polypropylene, polyurethane, acrylic resin, epoxy resin, silicon resin, alkyd resin and a vinyl chloride-vinyl acetate copolymer.

The electroconductive particles according to the present invention may preferably have a volume resistivity of $10^8$ Ω·cm or less, more particularly $10^5$ Ω·cm or less, as exemplified by metal particles, metal oxide particles and carbon black. It is preferable in terms of realizing satisfactory transparency to use metal oxide particles. The metal oxide particles may preferably be very fine particles of a zinc oxide, a titanium oxide, a tin oxide, an antimony oxide, an indium oxide, a bismuth oxide, an indium oxide containing doped tin, a tin oxide containing doped antimony or a zirconium oxide or their mixtures.

The content of the electroconductive particles may preferably be 5 to 90 wt %, more preferably 10 to 80 wt % of the overall weight of the protective layer. If the content of the electroconductive particles is less than 5 wt %, the resistance of the protective layer may be enlarged excessively. In this case, the residual potential will be undesirably raised or fog will be generated. If the content is more than 90 wt %, the resistance of the protective layer may be reduced excessively. In this case, the charging capacity will deteriorate, the residual potential will increase, the fog will be generated, pinholes will be generated and image blur will take place.

When the particles are dispersed in the protective layer as described above, dispersion of exposure light which occurs by the dispersed particles must be prevented wherein the particle size is made smaller than the wave length of the exposure light. In order to make uniform the conductivity, the particles having minimum size must be uniformly dispersed. The electroconductive particles according to the present invention have an average primary particle size before dispersing of preferably 0.1 μm or less, more preferably 0.05 μm or less.

The ionic polymerizable compound according to the present invention has two or more ionic polymerizable functional groups exhibiting relative affinity with the electroconductive particles, and therefore excellent electroconductive particle dispersion characteristics and dispersion stability can be obtained. Therefore, very fine particles of the foregoing type can uniformly be dispersed. As a result, excellent transparency and electroconduction uniformity can be realized. Since further improved dispersion characteristic and dispersion stability can be obtained, it is preferable that the ionic polymerizable compound has three or more functional groups.

Table 1 shows (1) the average primary particle size of the tin oxide particles before dispersing, (2) the average particle size of the tin oxide particles in the coating liquid, and (3) the average particle size of the tin oxide particles in the coating liquid after standing for one month after dispersing. The coating liquid was prepared by mixing 60 parts (parts by weight similarly to hereinafter) of the ionic polymerizable compound represented by the following formula:

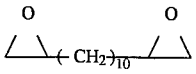

30 parts of tin oxide particles containing antimony and 30 parts of toluene, and then the mixed solution was dispersed by a sand mill for 48 hours. The average primary particle sizes before the dispersing step are average values of the particle sizes of 100 arbitrary particles each having a particle size of 0.005 μm or larger observed by a transmitting electron microscope (TEM) of 200,000 magnification. The average particle sizes of the dispersed particles in the coating liquid were measured by Horiba CAPA-700 manufactured by Horiba.

TABLE 1

| | Primary Particles Before Dispersing | Particles in Coating Liquid Immediately After Dispersing | Particles in Coating Liquid 1 month after Dispersing |
|---|---|---|---|
| Average Particle Size of Tin Oxide Particles (μm) | 0.04<br>0.08<br>0.10<br>0.20 | 0.06<br>0.10<br>0.12<br>0.25 | 0.06<br>0.15<br>0.15<br>0.30 |

As can be understood from Table 1, the particle size after dispersing considerably approximates the particle size of the primary particles, and the particles could be dispersed without any excessive change of the particle size even after time has passed. As a result, an excellent dispersion characteristic was realized.

The volume resistivity of the protective layer according to the present invention may preferably be $10^{15}$ to $10^{9}$ Ω·cm, more preferably $10^{14}$ to $10^{10}$ Ω·cm. The thickness of the protection layer may preferably be 0.1 to 10 μm, more preferably 0.5 to 7 μm.

The protective layer according to the present invention may be formed by applying, over a photosensitive layer, a mixture containing electroconductive particles dispersed in the ion polymerizable compounds by using an adequate solvent and by drying and hardening the applied mixture. As an alternative to this, the protective layer may be formed by dispersing the electroconductive particles in the lower molecular weight materials of the ion polymerizable compounds, such as oligomer, by a mixer, and by applying the mixture over a photosensitive layer, and by drying and hardening the same. In order to obtain further satisfactory dispersion characteristics, it is preferable to employ the former method. As the application method, a spray coating method and a beam coating method may be employed, and furthermore a dipping coating method may also be employed by selecting a used solvent.

It is preferable to add a coupling material and/or an antioxidant to the protective layer in order to further improve the dispersion characteristic, the adhesion characteristic and the stability against environment. Among the coupling materials, the coupling material containing fluorine atoms is more preferable because of its excellent water repellency. The content of the coupling material may preferably be 0.001 to 10 wt %, more preferably 0.01 to 1 wt %, and most preferably 0.05 to 0.5 wt % of the ion polymerizable compound.

The structure of the photosensitive layer may be a so-called single layer type structure containing both charge generating substances and charge transfer substances or a so-called laminated type structure including a charge transporting layer containing the charge transporting substances and a charge generating layer containing the charge generating substances. The laminated type photosensitive layer may assume a structure including a charge generating layer disposed on a charge transporting layer, or a charge transporting layer disposed on a charge generating layer. The charge generating layer can be formed by dispersing the charge generating substances exemplified by: azo pigment, such as monoazo pigment, disazo pigment or trisazo pigment; quinone type pigment; quinocyanine pigment; perylene pigment; indigo type pigment, such as indigo or thioindigo; azulenium pigment; and phthalocyanine pigment in a binder resin such as polyvinyl butyral, polyvinyl benzal, polyarylate, polycarbonate, polyether, polystyrene, polyvinyl acetate, acrylic resin, polyurethane, polyvinyl pyrrolidone, ethylcellulose or cellulose acetate butylate, by applying the dispersion solution and by drying the same. The thickness of the charge generating layer may preferably be 5 μm or less, more preferably 0.05 to 2 μm.

The charge transporting layer can be formed by dissolving, in a binder resin having a film forming characteristic, the charge transfer substance, such as a polycyclic aromatic compound including a structure selected from the group consisting of biphenylene, anthracene, pyrene or phenantholene; a nitrogen-contained ring compound such as indole, carbazole, oxadiazole or pyrazoline; a hydrazone compound; or a styryl compound, and by applying and drying the thus-prepared coating liquid. The binder resin is exemplified by polyester, polycarbonate, acrylic resin, polyarylate, an acrylonitryle-styrene copolymer, a polymethacrylic acid ester, polystyrene, poly-N-vinyl carbazole and polyvinyl anthracene. The thickness of the charge transporting layer may preferably be 5 to 40 μm, more preferably 10 to 30 μm.

The single layer type photosensitive layer may be formed by a combination of a charge generating substance, a charge transporting substance, and optionally a binder resin described above. In this case, it is also a charge transfer complex, e.g., a combination of poly-N-vinyl carbazole and trinitrofluorene. The thickness of the film may preferably be 5 to 40 μm, more preferably 10 to 30 μm.

The present invention is able to improve the adhesion characteristic and coating characteristic by forming an intermediate layer between the photosensitive layer and the protective layer. The intermediate layer may be formed by a material, such as casein, polyvinyl alcohol, nitrocellulose, ethylene-acrylic acid copolymer, alcohol-soluble polyamide, polyurethane, gelatin or aluminum oxide. The thickness of the intermediate layer may preferably be 0.1 μm to 10 μm, more preferably 0.3 μm to 2 μm.

An electroconductive substrate according to the present invention is not limited particularly so far as it has conductivity. For example, a material may be selected from the group consisting of a metal or alloy such as aluminum, aluminum alloy, copper, chrome, nickel, zinc or stainless steel; a material formed by laminating metal foil made of aluminum or copper on a plastic film; material formed by evaporating, on to a plastic film, aluminum, indium or a tin oxide; and metal, a plastic film or paper to which an electroconductive substance is, solely or with an adequate binder resin, applied to form an electroconductive layer. The electroconductive substance is exemplified by metal powder, metal foil or short metal fibers of aluminum, copper, nickel or silver; metal foil or short metal fibers; an electroconductive metal oxide such as an antimony oxide, an indium oxide or a tin oxide; an electroconductive polymer such as polypyrrole, polyaniline or a polymer electrolyte; carbon fiber, carbon black or graphite powder; an organic or inorganic electrolyte; and electroconductive powder covered with the foregoing electroconductive substances. The electroconductive substrate may arbitrarily be formed into a drum shape, a sheet shape or a belt shape to be adaptable to the electrophotographic apparatus.

In the present invention an undercoating layer having both a barrier function and an adhesion function may be disposed between the electroconductive substrate and the photosensitive layer. The undercoating layer may be made of the material similar to those of the intermediate layer formed between the protective layer and the photosensitive layer. The thickness may preferably be 0.1 to 5 μm, more preferably 0.5 to 3 μm. The undercoating layer may contain electroconductive particles such as metal, a metal oxide or carbon black. Another structure may be employed which comprises an undercoating layer containing the electroconductive particles and an undercoating layer containing no electroconductive particles formed on the electroconductive substrate in the foregoing sequential order. The thickness of the undercoating layer containing the electroconductive particles may preferably be 0.1 μm to 50 μm, more preferably ranges from 0.5 to 40 μm.

Each of the foregoing layers can be formed by using an adequate solvent, by employing any one of the following methods selected from the group consisting of a dipping coating method, a spray coating method, a beam coating method, a spinner coating method, a roller coating method, a Meyer bar coating method and a blade coating method and by drying the applied solvent.

The electrophotographic photosensitive member according to the present invention can generally be applied to an electrophotographic apparatus, such as a laser beam printer, an LED printer or a liquid crystal shutter printer. Further, it can widely be used in a display to which electrophotographic technology is applied, a recording apparatus, a light-duty printing apparatus, a facsimile machine, and a laser processing operation.

FIG. 1 illustrates the schematic structure of an electrophotographic apparatus using the electrophotographic photosensitive member according to the present invention.

Referring to FIG. 1, reference numeral 1 represents a drum-shape electrophotographic photosensitive member according to the present invention, the electrophotographic photosensitive member 1 being rotated at a predetermined circumferential speed in a direction of an arrow around a shaft 1*a*. While the photosensitive member 1 is rotating, the surface of the photosensitive member 1 is uniformly charged with a predetermined level of positive or negative potential by a charging means 2. Then, an exposure portion 3 is exposed to optical image exposure L (e.g., slit exposure or laser beam scan exposure) by an image exposure means (omitted from illustration). Thus, electrostatic latent images corresponding to the exposed images are sequentially formed on the surface of the photosensitive member.

The thus-formed electrostatic latent images are developed with toner by a developing means 4. The toner development images are then sequentially transferred to a transfer material P sent to a space between the photosensitive member 1 and a transfer means 5 from a paper supply unit (omitted from illustration) while being synchronized with the rotations of the photosensitive member 1.

The transfer material P which has received the transferred image is separated from the surface of the photosensitive member, and then it is introduced into an image fixing means 8 so that the image is fixed. Then, the transfer material P is printed out as a copied product (a copy).

The surface of the photosensitive member 1, from which the image has been transferred as described above, is subjected to a process for removing the toner left from the transferring operation by a cleaning means 6. Then, retained electricity on the surface is removed by a pre-exposure means 7 so that it is used repeatedly.

The present invention may be arranged in such a manner that the foregoing electrophotographic photosensitive member and at least one means selected from the group consisting of the charging means 2, the developing means 4 and the cleaning means 6 are integrated to be formed into a device unit which is attachable/detachable to and from the apparatus body by using a guide means, for example, a rail arranged into the apparatus body.

In a case where the electrophotographic apparatus is used as a copying machine or a printer, the optical image exposure L is performed by irradiating the photosensitive member with light reflected or transmitted through an original document. As an alternative to this, a method may be employed which is arranged in such a manner that the original document is read by a sensor to form data into signals, and a scan with laser beams is performed, an LED array and a liquid crystal shutter are operated in accordance with the signal to irradiate the photosensitive member with light.

Figure 2:
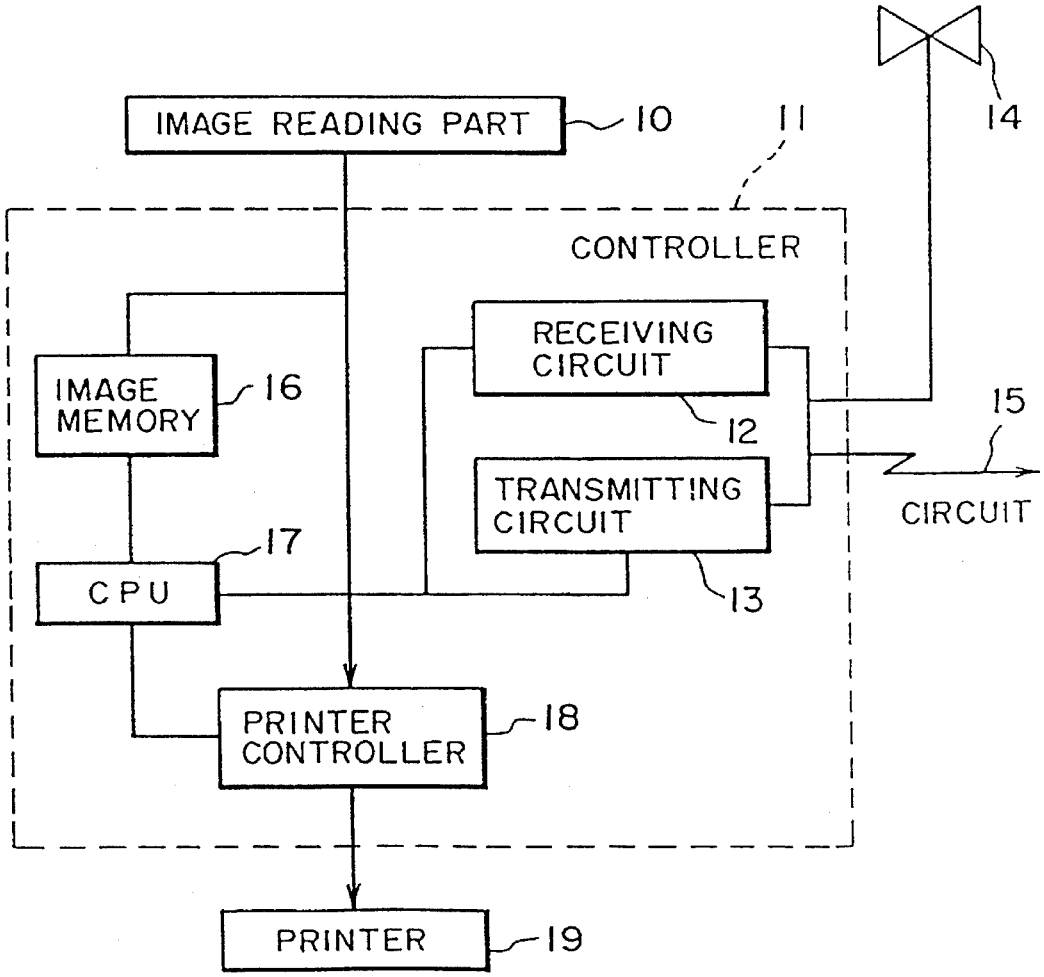
FIG. 2 is a block diagram of a facsimile machine employing the electrophotographic photosensitive member according to the present invention.

If the optical image exposure L is used as a printer of a facsimile machine, it is operated to print received data. FIG. 2 is a block diagram which illustrates an example of the foregoing case.

A controller 11 controls an image reading portion 10 and a printer 19. The controller 11 is fully controlled by a CPU 17. Read data supplied from the image reading port 10 is transmitted to the other end station through a transmission circuit 13. Data received from the other end station is sent to the printer 19 through a receiving circuit 12. An image memory stores predetermined image data. A printer controller 18 controls the printer 19. Reference numeral 14 represents a telephone.

An image (image information supplied from a remote terminal connected by a line 15) received through a line 15 is demodulated by the receiving circuit 12. Then, image information items are decoded by the CPU 17, and then sequentially stored in a memory 16. After images for at least one page have been stored in the memory 16, images of the page are recorded. The CPU 17 reads out image information about the one page to transmit the decoded image information about the one page to the printer controller 18. The printer controller 18 receives the image information for the one page from the CPU 17 and controls the printer 19 to record the image information about the page. The CPU 17 receives next page during the printing operation performed by the printer 19.

The image is received and recorded as described above.

EXAMPLE 1

50 parts (by weight hereinafter) of electroconductive titanium oxide particles covered with a tin oxide containing 10% antimony oxide, 25 parts of phenol resin (weight average molecular weight of 30,000), 20 parts of methyl cell solve, 5 parts of methanol, and 0.002 parts of silicon oil (polydimethyl siloxane-polyoxyalkylene copolymer, weight average molecular weight of 3,000) were dispersed by a sand mill using glass beads each having a diameter of 1 mm, so that paint for the electroconductive layer was obtained. An aluminum cylinder (a diameter of 30 mm×a length of 260 mm) was dipped into the foregoing paint and was coated with the same. Then, the paint was dried at 140° C. for 30 minutes, so that an electroconductive layer having a thickness of 20 μm was formed.

Then, 10 parts of alcohol-soluble copolymer nylon (weight average molecular weight of 29,000) and 30 parts of methoxy methylated 6 nylon (weight average molecular weight of 32,000) were dissolved in a mixture solvent of 260 parts of methanol and 40 parts of butanol. The thus-prepared solution was applied on the electroconductive layer by dipping and then it was dried, so that an undercoating layer having a thickness of 1 μm was formed.

Then, 4 parts of diazo pigment represented by the following formula, 2 parts of polyvinyl butyral (degree of butyration of 68%, weight average molecular weight of 24,000) and 34 parts of cyclohexane were dispersed by a sand mill using glass beads each having a diameter of 1 mm for 12 hours:

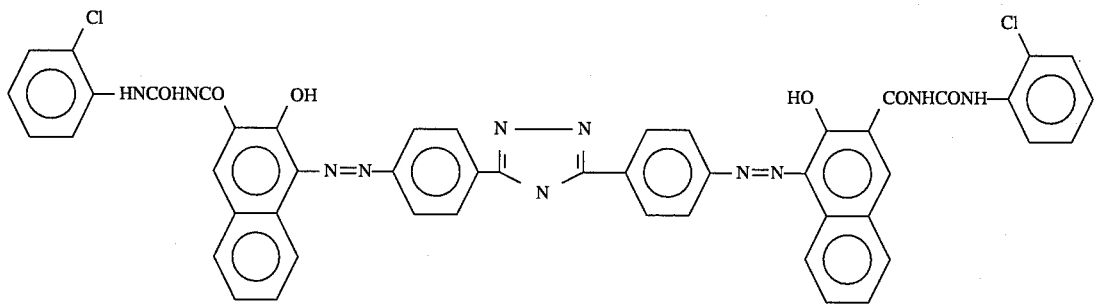

Then, 60 parts of tetrahydrofuran were added, so that paint for the charge generating layer was obtained. The thus-obtained paint was applied on the foregoing under coating layer by spraying, the paint being then dried at 80° C. for 15 minutes. As a result, a charge generating layer having a thickness of 0.15 μm was formed.

Then, 10 parts of styryl compound represented by the following formula and 10 parts of polycarbonate (weight average molecular weight of 46,000) were dissolved in a mixture solvent of 20 parts of dichloromethane and 40 parts of monochlorobenzene.

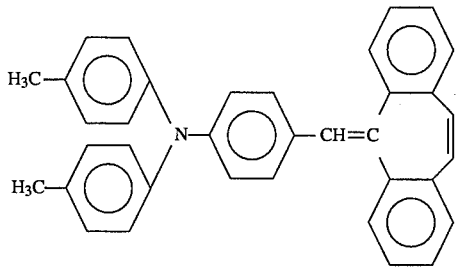

The thus-prepared solution was applied on the charge generating layer by dipping, and then it was dried at 120° C. for 60 minutes, so that a charge transporting layer having a thickness of 18 μm was formed.

Then, 60 parts of the ionic polymerizable compound according to the example compound No. 3, 30 parts of very fine particles of a tin oxide having an average primary particle size of 0.04 μm before dispersing, 0.1 parts of triphenyl sulfonium hexafluoroantimonate as a photo initiator and 300 parts of toluene were dispersed by a sand mill for 48 hours, so that a solution for the protective layer was obtained. The thus-obtained solution was applied on the charge transporting layer by beam coating, and then it was dried. Then, it was optically hardened with light having an intensity of 8 mW/cm$^2$ by a high pressure mercury lamp for 20 seconds. Then, it was heated at 100° C. for 30 minutes, so that a protective layer having a thickness of 4 μm was formed. The solution for the protective layer exhibited excellent dispersion characteristic and the layer had a uniform surface free from unevenness. The average particle size of tin oxide particles dispersed in the solution for the protective layer was measured by the measuring method employed to obtain the results shown in Table 1, resulting in a value of 0.04 μm.

The thus-obtained electrophotographic photosensitive member was negatively charged by corona discharging at −5 KV by using an electrostatic copying paper testing apparatus Model SP-428 manufactured by Kawaguchi Denki. Then, it was held in a dark place for one second, and exposed to light having an illuminance of 2 luxes for 10 seconds by using a halogen lamp to evaluate the charging characteristics of the photosensitive member. The charging characteristics were evaluated in such a manner that the surface potential (the potential in a dark portion), an exposure quantity (E½) required for halving the surface potential after standing in a dark portion for one second, that is, the sensitivity and the residual potential, were measured.

Further, the obtained photosensitive member was mounted on a positive development type electrophotographic copying machine which repeats a charging process, an exposure process, a development process, a transfer process and a cleaning process in a period of 1.5 seconds and subjected to a durability test by 100,000 sheets of repeative image formation. The images obtained before and after the durability test were visually evaluated. An eddy current film thickness meter manufactured by KETT was used to measure the thickness of the photosensitive member before the durability test and the thickness after the durability test, so that the quantity of abrasion thickness was measured. The results are shown in Table 2.

EXAMPLE 5

An electroconductive layer and an undercoating layer were formed on an aluminum cylinder similarly to Example 1.

Then, 10 parts of charge transporting substance represented by the following formula and 10 parts of polycarbonate (weight average molecular weight of 25,000) were dissolved in a mixture solution of 20 parts of dichloromethane and 40 parts of monochlorobenzene:

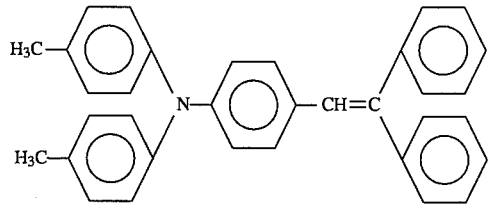

The thus-obtained solution was, by dipping, applied to the undercoating layer, and it was dried at 120° C. for 60 minutes, so that a charge transporting layer having a thickness of 20 μm was formed.

Then, 4 parts of disazo pigment represented by the following formula, two parts of polyvinyl benzal (degree of benzalation of 80%, weight average molecular weight of 11,000) and 30 parts of cyclohexane were dispersed by a sand mill using glass beads each having a diameter of 1 mm.

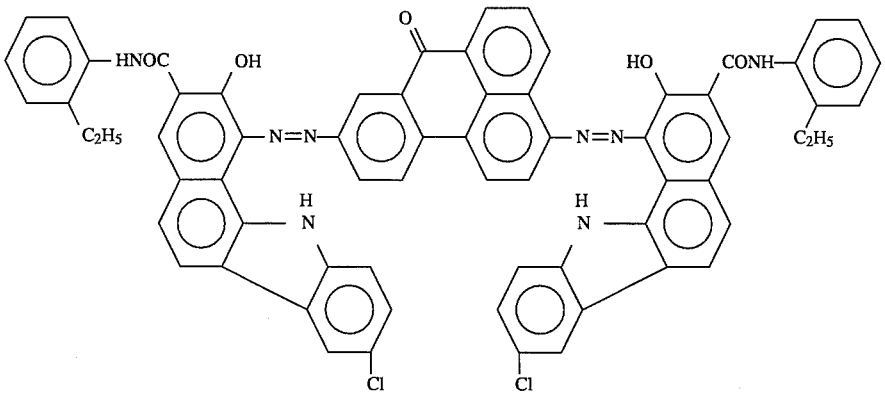

EXAMPLES 2 to 4

An electrophotographic photosensitive member was manufactured similarly to Example 1 except that the ion polymerizable compounds (Example Compounds 1, 11 and 18) were used in place of the ion polymerizable compound (Example Compound 3) as to be evaluated. The results are shown in Table 2.

Then, 60 parts of methyl ethyl ketone were added, so that paint for the charge generating layer was obtained. The paint was applied on the charge transporting layer by spraying, and it was dried at 80° C. for 15 minutes, so that the charge generating layer having a thickness of 0.10 μm was formed.

Then, 60 parts of the ionic polymerizable compound (Example Compound 20), 30 parts of very fine particles of tin oxide having an average primary particle size of 0.04 μm before dispersing, 0.06 parts of triphenyl sulfonium hexafluoroantimonate as a photo initiator and 300 parts of toluene were dispersed for 24 hours by a ball mill, so that a solution for the protective layer was obtained. The thus-obtained solution was applied to the charge generating layer by beam coating, and it was dried. Then, it was optically hardened for 30 seconds with light having an intensity of 8 $mW/cm^2$ by a high pressure mercury lamp, and it was heated at 80° C. for 60 minutes, so that the protective layer was formed. The protective layer had a thickness of 4.5 μm. The solution for the protective layer exhibited excellent dispersion characteristic and the layer had a uniform surface without unevenness. The average particle size of tin oxide particles dispersed in the solution for the protective layer was measured similarly to Example 1. The resulting average particle size was 0.04 μm.

The charging characteristics of the obtained electrophotographic photosensitive member were evaluated similarly to Example 1, while making the charge polarity to be positive.

The obtained photosensitive member was subjected to an image forming durability test similar to Example 1. However, a laser printer was used to charge positively in place of the electrophotographic copying machine, the laser printer repeating a process of charge, laser exposure, development, transfer and cleaning in a period of 1.5 seconds. The results are shown in Table 2.

EXAMPLE 6

An electrophotographic photosensitive member was manufactured similarly to Example 5 except that the solution for the protective layer was formed by dispersing, in a sand mill for 24 hours, 30 parts of Example Compound 7, 30 parts of Example Compound 22, 50 parts of very fine particles of tin oxide having an average primary particle size of 0.04 μm before dispersing, 0.1 parts of 2-methyl thioxantone as a photoinitiator and 300 parts of toluene. Then, evaluations were made similarly to Example 5, resulting in as shown in Table 2.

EXAMPLE 7

An electrophotographic photosensitive member was manufactured similarly to Example 1 except that the solution for the protective layer was formed by dispersing in a sand mill for 48 hours, 55 parts of the ionic polymerizable compound (Example Compound 17), 30 parts of very fine particles of tin oxide having an average primary particle size of 0.04 μm before dispersing, 0.1 parts of triphenyl sulfonium hexafluoroantimonate as a photoinitiator, 5 parts of a coupling material represented by the following formula and 300 parts of toluene:

$$CF_3CH_2CH_2Si(OCH_3)_3$$

The thus-obtained electrophotographic photosensitive member was evaluated similarly to Example 1. The results are shown in Table 2. The average particle size of tin oxide particles in the solution for the protective layer was 0.04 μm.

EXAMPLE 8

An electrophotographic photosensitive member was manufactured similarly to Example 5 except that the solution for the protective layer was formed by dispersing, in a sand mill for 24 hours, 45 parts of the ionic polymerizable compound (Example Compound 22), 45 parts of very fine particles of tin oxide having an average primary particle size of 0.04 μm before dispersing, 0.06 parts of triphenyl sulfonium hexafluoroantimonate as a photoinitiator, 10 parts of a coupling material represented by the following formula and 300 parts of toluene:

$$C_6F_{13}CH_2CH_2Si(OC_2H_5)_3$$

The thus-obtained electrophotographic photosensitive member was evaluated similarly to Example 5. The results are shown in Table 2. The average particle size of tin oxide particles in the solution for the protective layer was 0.04 μm.

Comparative Example 1

An electrophotographic photosensitive member was manufactured similarly to Example 1 except that the protective layer was not formed. The thus-obtained electrophotographic photosensitive member was evaluated similarly to Example 1. As a result, although satisfactory initial electrophotographic characteristics were obtained as shown in Table 2, an image defect occurred after the member had been subjected to 50,000 sheets of durability test because of the abrasion and scratch of the charge transporting layer.

Comparative Example 2

An electrophotographic photosensitive member was manufactured similarly to Example 1 except that a monofunctional compound represented by the following formula was used in place of the ionic polymerizable compound (Example Compound No. 3) to be evaluated. The average particle size of tin oxide particles in the protective layer was 0.13 μm. The results are shown in Table 2.

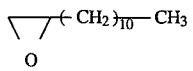

Comparative Example 3

An electrophotographic photosensitive member was manufactured similarly to Example 5 except that the binder resin in the protective layer was polycarbonate (weight average molecular weight of 46,000) to be evaluated. The results are shown in Table 2.

Comparative Example 4

An electrophotographic photosensitive member was manufactured similarly to Example 1 except that the very fine particles of tin oxide were not used and the thickness of the protective layer was made to be 1 μm to be evaluated. As a result, the residual potential was excessively high, some fog was generated and an image defect took place due to abrasion and scratch of the photosensitive member after 80,000 sheets as shown in Table 2.

Comparative Example 5

An electrophotographic photosensitive member was manufactured similarly to Example 5 except that a radical polymerizable compound represented by the following formula was used in place of the ionic polymerizable compound and 5 parts of 2-methyl-1-[4-(methylthio)phenyl]-2-morpholinopropane- 1 were used as a photoinitiator to be evaluated.

$$CH_2{=}CH-\underset{\underset{C}{\|}}{C}-O-(CH_2)_4-O-\underset{\underset{O}{\|}}{C}-CH{=}CH_2$$

As a result, the sensitivity was unsatisfactorily low, the residual potential was excessively high and image fog took place even in the initial stage as shown in Table 2. Therefore, the image forming durability test was not performed.

TABLE 2

| | Charging Characteristics | | | Image Evaluation | | Amount |
|---|---|---|---|---|---|---|
| | Dark Potential (V) | Sensitivity (lux.sec) | Residual Potential (V) | Pre-durability | Post-Durability | of abrasion (μm) |
| E1 | −820 | 2.3 | −25 | Excellent | Excellent | 2.0 |
| E2 | −790 | 2.4 | −30 | Excellent | Excellent | 2.5 |
| E3 | −750 | 2.3 | −40 | Excellent | Excellent | 2.2 |
| E4 | −780 | 2.1 | −20 | Excellent | Excellent | 2.0 |
| E5 | +770 | 2.3 | +45 | Excellent | Excellent | 2.1 |
| E6 | +800 | 2.2 | +30 | Excellent | Excellent | 1.5 |
| E7 | −800 | 2.0 | −20 | Excellent | Excellent | 1.6 |
| E8 | +790 | 2.0 | +20 | Excellent | Excellent | 1.7 |
| C1 | −820 | 1.9 | −10 | Excellent | Image defect took place after 5000 sheets had been made | 6.0 |
| C2 | −680 | 4.0 | −20 | Black dots and image unevenness took place | Black dots increased and unevenness became excessively | 4.0 |
| C3 | +600 | 3.8 | +80 | Black dots were generated | Image defect took place after 3000 sheets had been made | 4.5 |
| C4 | −840 | 2.6 | −80 | Allowable | Image defect took place after 80,000 sheets were made | 1.5 |
| C5 | +820 | 3.0 | +90 | Fog generated | — | — |

(Note) E is an abbreviation of Example, while C is an abbreviation of Comparative Example.

Although the invention has been described in its preferred form with a certain degree of particularly, it is understood that the present disclosure of the preferred form can be changed in the details of construction and the combination and arrangement of parts may be resorted to without departing from the spirit and the scope of the invention as hereinafter claimed.

What is claimed is:

1. An electrophotographic photosensitive member comprising:

an electroconductive substrate;

a photosensitive layer disposed on said electroconductive substrate; and a protective layer disposed on said photosensitive layer, said protective layer containing a resin formed by ionic polymerization of compounds each having two or more ionic polymerizable functional groups, and electroconductive particles.

2. An electrophotographic photosensitive member according to claim 1, wherein said resin has a crosslinked structure.

3. An electrophotographic photosensitive member according to claim 1, wherein said compound has three or more ionic polymerizable functional groups.

4. An electrophotographic photosensitive member according to claim 1, wherein said protective layer is formed by hardening a mixture containing the compounds and the electroconductive particles.

5. An electrophotographic photosensitive member according to claim 1, wherein said ionic polymerizable functional group is selected from the group consisting of epoxy materials, vinyl ethers, electron donative vinyl materials, ring ethers, thiirane ring materials and ring polyorganosiloxane.

6. An electrophotographic photosensitive member according to claim 4, wherein the mixture is hardened by irradiation with light in the presence of a photopolymerization initiator.

7. An electrophotographic photosensitive member according to claim 6, wherein said photopolymerization initiator is selected from the group consisting of aromatic diazonium salt, aromatic halonium salt, photosensitive aromatic onium salt of group IVa element and photosensitive aromatic onium salt of group Va element.

8. An electrophotographic photosensitive member according to claim 6, wherein said light is ultraviolet radiation.

9. An electrophotographic photosensitive member according to claim 1, wherein said electroconductive particles are selected from the group consisting of metal particles, metal oxide particles and carbon black.

10. An electrophotographic photosensitive member according to claim 9, wherein said electroconductive particles are metal oxide particles.

11. An electrophotographic photosensitive member according to claim 1, wherein said electroconductive particles have an average primary particle size of 0.1 μm or less.

12. An electrophotographic photosensitive member according to claim 11, wherein said electroconductive particles have an average primary particle size of 0.05 μm or less.

13. An electrophotographic photosensitive member according to claim 1, wherein said protective layer contains a coupling material.

14. An electrophotographic photosensitive member according to claim 13, wherein said coupling material contains a fluorine atom.

15. An electrophotographic photosensitive member according to claim 1, wherein said photosensitive layer has a charge generating layer and a charge transporting layer.

16. An electrophotographic photosensitive member according to claim 1, wherein an undercoating layer is disposed between said electroconductive substrate and said photosensitive layer.

17. An electrophotographic photosensitive apparatus, comprising:

an electrophotographic photosensitive member;

means for forming an electrostatic latent image on said photosensitive member;

means for developing the formed electrostatic latent image; and means for transferring a developed image to a transfer medium, said electrophotographic photosensitive member comprising an electroconductive substrate, a photosensitive layer disposed on said electroconductive substrate, and a protective layer disposed on said photosensitive layer, said protective layer containing a resin formed by ionic polymerization of compounds each having two or more ionic polymerizable functional groups, and electroconductive particles.

18. A device unit comprising:

an electrophotographic photosensitive member and at least one means selected from a group consisting of charging means, developing means and cleaning means, said electrophotographic photosensitive member comprising an electroconductive substrate, a photosensitive layer disposed on said electroconductive substrate and a protective layer disposed on said photosensitive layer, said protective layer containing a resin formed by ionic polymerization of compounds each having two or more ionic polymerizable functional groups, and electroconductive particles, said unit integrally supporting said electrophotographic photosensitive member and at least one means selected from the group consisting of said charging means, said developing means and said cleaning means, and said unit being made attachable/detachable to and from an apparatus body.

* * * * *

UNITED STATES PATENT AND TRADEMARK OFFICE

CERTIFICATE OF CORRECTION

PATENT NO. : 5,455,135

DATED : October 3, 1995

INVENTOR : AKIO MARUYAMA, ET AL.

It is certified that errors appear in the above-identified patent and that said Letters Patent is hereby corrected as shown below: On the title page, item:

[54] Title

"APPARTUS" should read --APPARATUS--.

COLUMN 1

Line 4, "APPARTUS" should read --APPARATUS--; and

Line 53, "repeated." should read --repeatedly.--.

COLUMN 2

Line 32, "be" should be deleted.

COLUMN 5

After the last line, insert
--Number of Functional Groups: 6

¶ Example Compound 19

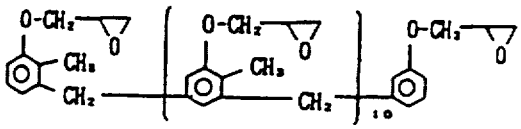

Number of Functional Groups: 12

UNITED STATES PATENT AND TRADEMARK OFFICE

CERTIFICATE OF CORRECTION

PATENT NO. : 5,455,135

DATED : October 3, 1995

INVENTOR : AKIO MARUYAMA, ET AL.

It is certified that errors appear in the above-identified patent and that said Letters Patent is hereby corrected as shown below:

COLUMN 5, Cont'd.

Example Compound 20

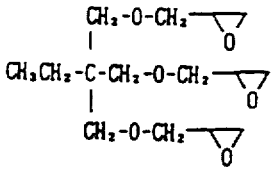

Number of Functional Groups 3

Example Compound 21

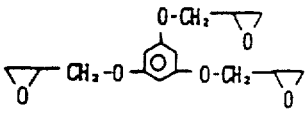

Number of Functional Groups 3

Example Compound 22

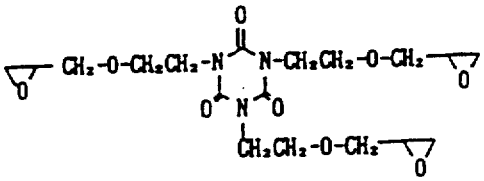

UNITED STATES PATENT AND TRADEMARK OFFICE

CERTIFICATE OF CORRECTION

PATENT NO. : 5,455,135

DATED : October 3, 1995

INVENTOR : AKIO MARUYAMA, ET AL.

It is certified that errors appear in the above-identified patent and that said Letters Patent is hereby corrected as shown below:

COLUMN 5, Cont'd.

Number of Functional Groups: 3

Example Compound 23

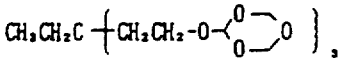

Number of Functional Groups: 3

Example Compound 24

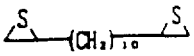

Number of Functional Groups: 2

Example Compound 25

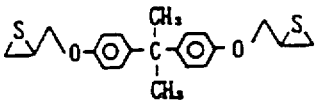

Number of Functional Groups: 2

Example Compound 26

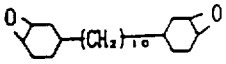

Number of Functional Groups: 2

UNITED STATES PATENT AND TRADEMARK OFFICE

CERTIFICATE OF CORRECTION

PATENT NO. : 5,455,135

DATED : October 3, 1995

INVENTOR : AKIO MARUYAMA, ET AL.

It is certified that errors appear in the above-identified patent and that said Letters Patent is hereby corrected as shown below:

COLUMN 5, Cont'd.

Example Compound 27

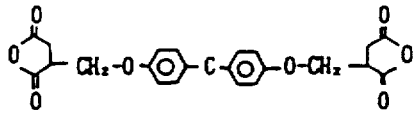

Number of Functional Groups: 2 --

COLUMN 11

Line 36, "characteristic" should read --characteristics--.

COLUMN 17

Line 32, "repeative" should read --repetitive--.

COLUMN 21

Table 2, "excessively" should read --excessive--; and

Line 43, "particularly," should read --particularity,--.

UNITED STATES PATENT AND TRADEMARK OFFICE

CERTIFICATE OF CORRECTION

PATENT NO. : 5,455,135

DATED : October 3, 1995

INVENTOR : AKIO MARUYAMA, ET AL.

It is certified that errors appear in the above-identified patent and that said Letters Patent is hereby corrected as shown below:

COLUMN 22

Line 7, "thiirane" should read --thiooxysilane--.

Signed and Sealed this

Twenty-third Day of April, 1996

*Attest:*

*Attesting Officer*

BRUCE LEHMAN

*Commissioner of Patents and Trademarks*